US010465263B2

(12) United States Patent
Brandt et al.

(10) Patent No.: US 10,465,263 B2
(45) Date of Patent: Nov. 5, 2019

(54) SYSTEM AND METHOD FOR ADDING MOLTEN LITHIUM TO A MOLTEN ALUMINIUM MELT

(71) Applicant: ALERIS ROLLED PRODUCTS GERMANY GMBH, Koblenz (DE)

(72) Inventors: Fred Brandt, Neuwied (DE); Philippe Meyer, Koblenz (DE)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 203 days.

(21) Appl. No.: 14/900,596

(22) PCT Filed: Jun. 30, 2014

(86) PCT No.: PCT/EP2014/063800

§ 371 (c)(1),
(2) Date: Dec. 21, 2015

(87) PCT Pub. No.: WO2015/003940

PCT Pub. Date: Jan. 15, 2015

(65) Prior Publication Data

US 2016/0160318 A1 Jun. 9, 2016

(30) Foreign Application Priority Data

Jul. 11, 2013 (EP) ..... 13176169

(51) Int. Cl.
*C22B 21/06* (2006.01)
*F27B 14/08* (2006.01)
(Continued)

(52) U.S. Cl.
CPC ..... *C22B 21/06* (2013.01); *B22D 1/00* (2013.01); *B22D 1/002* (2013.01); *C22B 9/003* (2013.01);
(Continued)

(58) Field of Classification Search
CPC ..... B22D 1/00; B22D 1/002; C22B 21/0084; C22B 21/04; C22B 21/06; C22B 21/064;
(Continued)

(56) References Cited

U.S. PATENT DOCUMENTS 1,944,733 A * 1/1934 Schoeffel ..... B22D 37/00 137/147
4,153,100 A * 5/1979 Balevski ..... B22D 18/08 164/155.4
(Continued)

FOREIGN PATENT DOCUMENTS

CN 1036521 A 10/1989
CN 102632226 * 8/2012 ..... C22B 21/06
(Continued)

OTHER PUBLICATIONS

CN102632226, English machine translation version, Dewu et al. Ingot casting method, equipment, accessory and refining and ingot casting integrated production process, Aug. 15, 2012, 22 pages (Year: 2012).*
(Continued)

*Primary Examiner* — Scott R Kastler
*Assistant Examiner* — Michael Aboagye
(74) *Attorney, Agent, or Firm* — Vorys, Sater, Seymour and Pease LLP

(57) ABSTRACT

A system for adding molten lithium and inert gas in a molten aluminium or aluminium alloy melt including, a crucible defining a chamber for melting and storing molten metal, in particular molten lithium; the crucible having a sealed lid; an inert gas delivery system for maintaining chamber overpressure using inert gas; a conduit for withdrawing a portion of the molten metal from the crucible. The conduit arranged with respect to the crucible or the sealed lid so the conduit inlet can be moved below and above the molten metal
(Continued)

surface level and arranged for feeding molten metal from the crucible to a separate holding furnace with the help of overpressure when the conduit inlet is below the molten metal surface level and arranged for feeding inert gas from the crucible to the separate holding furnace when the conduit inlet is above the molten metal surface level.

17 Claims, 1 Drawing Sheet

(51) Int. Cl.

| | |
|---|---|
| ***F27D 3/14*** | (2006.01) |
| ***C22B 21/00*** | (2006.01) |
| ***F27D 7/06*** | (2006.01) |
| ***C22B 9/00*** | (2006.01) |
| ***C22B 9/10*** | (2006.01) |
| ***F27B 14/04*** | (2006.01) |
| ***F27D 7/02*** | (2006.01) |
| ***C22B 21/04*** | (2006.01) |
| ***C22C 1/02*** | (2006.01) |
| ***B22D 1/00*** | (2006.01) |
| ***F27B 14/06*** | (2006.01) |

(52) U.S. Cl.
CPC ..... *C22B 9/006* (2013.01); *C22B 9/10* (2013.01); *C22B 21/0084* (2013.01); *C22B 21/04* (2013.01); *C22B 21/064* (2013.01); *C22C 1/026* (2013.01); *F27B 14/061* (2013.01); *F27B 14/0806* (2013.01); *F27D 3/14* (2013.01); *F27D 7/02* (2013.01); *F27D 7/06* (2013.01); *F27B 2014/0818* (2013.01); *F27D 2007/023* (2013.01); *F27D 2007/063* (2013.01)

(58) Field of Classification Search
CPC ..... C22B 9/003; C22B 9/006; C22B 9/10; C22C 1/026; F27B 14/061; F27B 14/0806; F27B 2014/0818; F27D 2007/023; F27D 2007/063
USPC ..... 266/236, 44, 91; 164/55.1, 57.1, 94, 95, 164/460, 471, 473, 475, 487, 258; 420/528
See application file for complete search history.

(56) References Cited

U.S. PATENT DOCUMENTS

| | | | | |
|---|---|---|---|---|
| 4,248,630 | A | 2/1981 | Balmuth | |
| 4,556,535 | A * | 12/1985 | Bowman | C22C 1/026 164/57.1 |
| 4,582,118 | A | 4/1986 | Jacoby et al. | |
| 4,761,266 | A * | 8/1988 | Bruski | C22C 1/026 266/95 |
| 4,767,598 | A | 8/1988 | Kinosz et al. | |
| 5,082,044 | A | 1/1992 | Christensen | |
| 5,415,220 | A | 5/1995 | Edwards | |
| 5,559,827 | A * | 9/1996 | Shimada | B22D 39/06 266/242 |
| 5,812,587 | A * | 9/1998 | Locatelli | B22D 41/04 266/242 |
| 6,551,424 | B1 | 4/2003 | Haszler et al. | |
| 6,926,066 | B2 * | 8/2005 | Boulet | B22D 17/30 164/317 |
| 2009/0226340 | A1 | 9/2009 | Marya | |
| 2011/0036534 | A1 | 2/2011 | Yeh et al. | |
| 2012/0291925 | A1 | 11/2012 | Bes et al. | |
| 2016/0160320 | A1 | 6/2016 | Brandt et al. | |

FOREIGN PATENT DOCUMENTS

| | | | |
|---|---|---|---|
| WO | 9421405 | A1 | 9/1994 |
| WO | 2015003934 | A1 | 1/2015 |

OTHER PUBLICATIONS

International Search Report and the Written Opinion dated Sep. 3, 2014 for International Patent Application No. PCT/EP2014/063800 to Aleris Rolled Products Germany GMBH having an International filed of Jun. 30, 2014.

Master Alloys—Our spice rack for the metal industry, KBM AFFILIPS Master Alloys, URL: < https://www.kbmaffilips.com/what-is-a-master-alloy/ >, retrieved from the Internet Mar. 15, 2017.

Chakravorty C R et al: "Melting and Casting Characteristics of Aluminium-Lithium Alloys", Proceedings IEEE Workshop on Interactive Voice Technology Fortelecommunications Applications, Jan. 1, 1990 XX, XX, vol. 2, No. 4, Jan. 1, 1990, pp. 182-191, XP000579349.

* cited by examiner

SYSTEM AND METHOD FOR ADDING MOLTEN LITHIUM TO A MOLTEN ALUMINIUM MELT

CROSS-REFERENCE TO RELATED APPLICATIONS

This is a § 371 National Stage Application of International Application No. PCT/EP2014/063800 filed on Jun. 30, 2014, claiming the priority of European Patent Application No. 13176169.4 filed on Jul. 11, 2013.

FIELD OF THE INVENTION

The invention relates to the manufacturing of aluminium alloys containing a purposive amount of lithium as alloying element, and more particularly, to a system, a method and an apparatus for adding molten lithium to a melt of molten aluminium or aluminium alloy.

BACKGROUND TO THE INVENTION

Aluminium alloys comprising lithium are very beneficial for use in the aerospace industry since the purposive addition of lithium may reduce the density of the aluminium alloy by about 3% and increase the modulus of elasticity by about 6% for each weight percent of lithium added. In order for these alloys to be selected in airplanes, their performance with respect to other engineering properties must be as good as that of commonly used alloys, in particular in terms of the compromise between the static mechanical strength properties and the damage tolerance properties. Over time a wide range of aluminium-lithium alloys have been developed with a corresponding wide range of thermo-mechanical processing routes. However, a key processing route remains the casting of ingots or billets for further processing by means of extrusion, forging and/or rolling. The casting process has proven to remain a problematic processing step in the industrial scale production of ingots and billets. There are, for example, others issues with regard to oxidation of molten metal in the furnaces, the transfer troughs and during casting itself.

On an industrial scale of manufacturing aluminium-lithium alloys these can be produced by adding lithium in solid form to an aluminium alloy melt in a furnace. The resultant Al—Li alloy is subsequently transferred to a casting station for casting into ingot or billet feedstock suitable for further processing by means of, for example, extrusion, forging and/or rolling.

US patent document US-2011/0036534-A1 (assigned to AMLI Materials Technology) discloses a process for producing a lithium-containing alloy material, including (1) placing at least one alloy element, in particular lithium, into a crucible in a vacuum induction melting furnace; (2) melting the lithium into an alloy melt by induction heating in the vacuum induction melting furnace; (3) pouring the alloy melt into a ladle protected with an inert gas and pre-filled with a lithium material; (4) shaking the ladle, to vigorously flush and mix the lithium material with the alloy melt, thus forming a molten lithium alloy; and (5) pouring the molten lithium alloy into a mould to form an ingot, thereby forming a lithium alloy. This process has various drawbacks and due to the required shaking operation of the ladle is not feasible for the mass production of molten aluminium-lithium alloys for DC-casting of feedstock for rolling, extrusion or forging.

U.S. Pat. No. 4,761,266 (assigned to Kaiser Aluminum) discloses a method for preparing an aluminium-lithium alloy at a preselected ratio of aluminium to lithium. The method comprises preparing an amount of molten lithium and an amount of molten aluminium melt. The molten lithium is filtered using stainless steel filters to remove solids from the molten lithium, notably lithium oxides and hydroxides. The molten aluminium melt is melt treated by degassing prior to mixing with the molten lithium. The molten lithium and molten aluminium are mixed in a complex apparatus incorporating a vortex bowl. The swirling action of the vortex causes mixing of the aluminium and lithium, which then proceeds as a homogeneous mixture downward through an exit passage at the base of a funnel. The mixture enters a degassing chamber, where the mixture is purged with argon. The purged mixture is then passed through a filter to remove any oxides and refractory fragments which may have entered the system. The molten mixture then enters an ingot casting station. This method has various disadvantages. For example, there is a sensitivity for viscosity of the alloy and thus for fluctuations in the temperature of the metal in the vortex bowl. Although the system is blanketed in an inert atmosphere, there will be entrapment of gas and oxides in the molten metal, which have to be removed subsequently. The alloying system is a complex and dynamic approach whereby small variations in metal flow may lead to undesirable changes in alloy composition in the final ingot.

DESCRIPTION OF THE INVENTION

It is an object of the invention to provide methodologies of producing molten aluminium-lithium alloy feedstock which allow for the preparation of large volumes of such feedstock in a more reliable and robust manner, or at least to provide an alternative methodology of producing molten aluminium-lithium alloys.

This and other objects and further advantages are met or exceeded by the present invention and providing a system for adding molten lithium and an inert gas in a melt of molten aluminium or aluminium alloy in a holding or melting furnace, the system comprising,

- a crucible defining a chamber for melting and storage of molten metal, in particular molten lithium;
- the crucible being equipped with a sealed lid to keep the crucible airtight;
- an inert gas delivery system arranged for maintaining an overpressure in the chamber of the crucible using an inert gas;
- a conduit, having a conduit inlet and a conduit outlet, for withdrawing a portion of the molten metal, preferably molten lithium, from the crucible, and wherein the conduit is movably arranged with respect to the crucible or the sealed lid such that in operation the conduit inlet can be controllably moved below and above the surface level of the molten metal, and wherein the conduit is arranged for feeding of the molten metal from the crucible to a separate molten metal holding furnace with the help of an overpressure when the conduit inlet is below the surface level of the molten metal, or submerged in the molten metal, and the conduit is further arranged for feeding of the inert gas from the crucible to the separate molten metal holding furnace when the conduit inlet is above the surface level of the molten metal.

In accordance with this invention it has been found that the system, and the corresponding method and apparatus, in operation can be provided with equipment for a dual-use function, namely to deliver in a controlled manner molten lithium to a melt of molten aluminium or aluminium alloy in a separate holding and/or melting furnace and also to deliver an inert gas to the same molten aluminium for reducing the hydrogen content (degassing) and particulate removal from the molten aluminium alloy. The dual-use function is achieved by using the airtight crucible having in a controlled manner an overpressure of an inert gas, e.g. helium or argon, and whereby argon is being preferred, in combination with a conduit movably arranged with respect to the crucible or lid. Depending whether the conduit inlet is above or below the surface level of the molten lithium, the conduit can be used to deliver in a controlled manner either molten lithium or inert gas fluxing to the melt of molten aluminium. When the inert gas fluxing is performed directly after the controlled transfer of molten lithium, it is also avoided that molten lithium remains in the conduit or possibly in a diffuser used in the molten aluminium in the separate holding furnace. This may allow for a controlled cooling of the conduit(s) reducing the risk of damaging the conduit(s) and avoids that any lithium remaining in a conduit and still at elevated temperature catches fire.

When working with molten lithium, the crucible is preferably in the form of a steel vessel or container, preferably made of low carbon steel or stainless steel. Preferably the steel vessel or container is made from stainless steel. And preferably without the use of refractory on the inside of the vessel or container which may lead to adverse pick-up of refractory fragments in the molten lithium which may end-up in the molten aluminium alloy and affect the feedstock quality.

The crucible, steel vessel or container may act for storage of the molten lithium only and whereby the lithium is being molten in a separate furnace and used to replenish the crucible, steel vessel or container in accordance with this invention, and to maintain the level of molten lithium within certain desired parameters.

Alternatively, the lithium can be molten and stored in the crucible, steel vessel or container itself.

To maintain in a controlled manner the molten lithium at elevated temperature and where appropriate also to melt the lithium metal, the system is provided with one or more heating units and temperature measurement and control means. The heating unit can be arranged to act as a direct heating source, e.g. electrical resistance heating, e.g. encapsulated into a steel, preferably a stainless steel, plunger, on the inside of the vessel. In another embodiment the heating means can be arranged to act indirectly, e.g. using electrical resistance or an oil bath surrounding at least a part of the outside of the vessel or container. The use of an oil bath is being preferred as it allows for an accurate temperature control and avoids any local overheating of the molten lithium. As an alternative to a heated bath also a heating mantle or isomantle can be used to apply heat to the vessel or container.

When transferring or transporting the molten lithium from the crucible to the molten aluminium in the separate holding furnace, the molten lithium is preferably at a metal temperature in the range of less than 260° C., and preferably in a range of 195° C. to 230° C., e.g. 210° C. or 220° C.

In an embodiment the system further comprising a supply tank of pressurised inert gas, the supply tank is interconnected to the chamber of the crucible through a gas delivery system that includes a pressure regulator and at least one valve mounted on a supply tube for the crucible. The inert gas is for transferring the molten lithium from the crucible into the molten aluminium in the separate holding furnace and also for fluxing of the molten aluminium in said holding furnace.

In an industrial scale arrangement of the system a working range for the overpressure would be in a range of about 15 to 200 mbar, and preferably in the range of about 40 to 80 mbar, depending on the height difference between the surface level of the molten lithium and of the molten aluminium in the separate holding furnace.

The crucible or vessel is pressurised using an inert gas, e.g. argon, so that molten lithium flows through the conduit into a separate furnace having the molten aluminium in a quiescent manner. A signal from the pressure regulator connected to the crucible can be taken by a controller for actuating on a valve so any loss or surplus of pressure in the crucible is carefully controlled during the feeding process. Transducers, along with the controller allow the system to automatically compensate for any pressure leaks that may exist in the system and permit a very fine control of the internal pressure in the crucible.

The transfer or transport of molten lithium through the conduit to the separate molten metal holding furnace with the help of overpressure in the crucible is controllable by measuring the drop in surface level of the molten lithium. The sensor is configured to indirectly measure the molten metal flow by measuring the reduction of the height of the molten lithium in the crucible. This can be (by way of illustration and not of limitation) any of a number of sensing devices, such as a capacitive sensor, an eddy current probe or a laser level sensor.

In an alternative and preferred embodiment, the transfer of molten lithium through the conduit to the separate molten metal holding furnace with the help of overpressure in the crucible is controllable by measuring the weight loss of the crucible resulting from the transfer of the molten lithium. This can be achieved by placing the crucible in an arrangement wherein one or more pressure sensors are arranged under the crucible or the platform on which it is positioned.

Also a combination of pressure sensors and measuring the drop of the surface level of the molten lithium is evidently feasible.

In another embodiment the transfer of molten lithium through the conduit to the separate molten metal holding furnace is limited by how far the conduit inlet is submerged into the molten lithium at the beginning of the transfer. During the transfer process the conduit inlet is kept at this position until the molten lithium level has dropped such that the conduit inlet is at the surface level of the molten lithium and the transfer has stopped. The depth at which the conduit inlet is being submerged can be adjusted to a known amount of molten lithium to be transferred.

The conduit for withdrawing a portion of molten lithium from the crucible can be part of a system of conduits connected or coupled to each other. There is a first conduit extending into the crucible, and there can be a second conduit transferring the molten lithium or inert gas as the case may be, away from the crucible towards the separate holding furnace containing the molten aluminium, and wherein there is provided a third conduit having a conduit end extending into or being submerged in the molten aluminium.

Preferably at least a part of the conduit system, e.g. the second conduit, is arranged with an upward inclination to facilitate a back flow of molten lithium from the conduit(s) when the over-pressure is reduced when the required amount of molten lithium has been transferred to the molten aluminium in the holding furnace.

The conduit or tube in contact with the molten lithium in the crucible is preferably made of steel, more in particular made of stainless steel.

A wide range of conduit diameters can be applied. Preferably the inner diameter of the conduits is in a range of 1 to 2 inch (2.54 to 5.08 cm).

The conduit or tube in contact with the molten aluminium in the separate holding furnace is preferably made of steel, more in particular of low carbon steel or stainless steel, and preferably having an appropriate aluminium resistant coating, in particular based on BN (boron nitride). Alternatively said conduit or tube is made of a ceramic material resistant to both molten lithium and to molten aluminium, and is preferably based on boron nitride.

In an embodiment one or more of the conduits are provided with thermal insulation material to avoid solidification of the molten lithium present in the conduit when being feed from the crucible to the molten aluminium in the holding furnace.

In a further embodiment next to the thermal insulation material a heating assembly is disposed about parts of one or more of the conduits located outside the crucible to avoid solidification of the molten lithium present in the conduit when being feed from the crucible into the molten aluminium in the holding furnace. For example an induction coil assembly is annularly disposed about at least a part of the conduit located outside the crucible. Preferably electrical resistance heating is being applied.

The invention further relates to a method for adding molten lithium and an inert gas in a melt of molten aluminium in a metal holding or melting furnace, placing lithium, either molten or solid, into a separate crucible comprising a chamber for melting and storage of molten lithium, and with a sealed lid, injecting inert gas into the chamber through an inert gas delivery system arranged for maintaining an overpressure in the chamber of the crucible using the inert gas to preferably provide an overpressure of inert gas, (if not yet molten) melting the lithium, placing into the molten lithium a conduit, having a conduit inlet and a conduit outlet, for withdrawing a portion of the molten lithium from the crucible into the melt of molten aluminium, the conduit being movably arranged with respect to the crucible such that the conduit inlet can be controllably moved below and above the surface level of the molten metal, typically this involves lowering the conduit inlet from a first upper position above the molten lithium to a second lower position within the molten lithium;

transferring a controlled amount of molten lithium from the crucible to the metal holding furnace by applying an overpressure of inert gas in the crucible while maintaining the conduit inlet below the surface level of the molten metal;

and thereafter bringing the conduit inlet above the surface level of the molten metal while maintaining an overpressure of inert gas in the crucible to feed inert gas from the crucible chamber through the conduit to the molten aluminium in the metal holding furnace.

Typically, the conduit is closed by a valve or other means while the lithium is melting.

It will be clear to the skilled person, that it is also possible to first flux the molten aluminium in the metal holding or melting furnace with an inert gas fed from the crucible, then feeding molten lithium, following by a next fluxing operation with an inert gas from the same crucible for reducing the hydrogen content and particulate removal from the molten aluminium alloy containing the lithium as purposive alloying element. Preferably the inert gas for fluxing the molten aluminium alloy has been preheated in the crucible. It has been found that a preheated fluxing gas provides for smaller gas bubbles in the molten aluminium resulting in a higher degassing efficiency.

The conduit or tube end in the molten aluminium holding furnace can be provided with a disperser or diffuser unit, e.g. made of boron nitride material, configured to permit the selective introduction of the purging molten lithium or purging inert gas into the molten aluminium alloy. The holding furnace may be electrically heated or may be an induction furnace. In particular in combination with an induction melting furnace the molten lithium is easily and fast dispensed in the molten aluminium alloy without unnecessary creation of oxides or gas entrapment. As well known to the skilled person, due to the operation of the inductors in an induction melting furnace the molten metal has currents going upwards from the bottom to near the surface and downwards from the surface to near the bottom of the furnace. In a preferred embodiment the molten lithium is introduced in the molten aluminium alloy through the conduit end or tube end, optionally with a disperser or diffuser unit, in a downward current to further facilitate the rapid mixing with the aluminium and thus create a good homogeneity of the aluminium alloy.

The invention further relates to an apparatus in the form of a crucible, steel vessel or container for melting, storage and delivery of molten lithium and of an inert gas under an overpressure, and comprising a crucible or vessel defining a chamber for melting and/or storage of molten lithium, equipped with a sealed lid to keep the crucible airtight, an inert gas delivery system arranged for maintaining an overpressure in the chamber of the crucible using an inert gas, and a conduit, having a conduit inlet and a conduit outlet, for withdrawing a portion of the molten lithium, from the crucible, and wherein the conduit is being movable arranged with respect to the crucible or vessel or container such that in operation the conduit inlet can be controllably moved below and above the surface level of the molten lithium, and wherein the conduit is arranged for feeding of the molten metal from the crucible to a separate molten metal holding furnace with the help of an overpressure when the conduit inlet is below the surface level of the molten metal, and the conduit is further arranged for feeding of the inert gas from the crucible to the separate molten metal holding furnace when the conduit inlet is above the surface level of the molten metal.

DESCRIPTION OF THE DRAWINGS

Some preferred embodiments of the invention shall now be described with reference to the appended drawing, in which.

Figure 1:
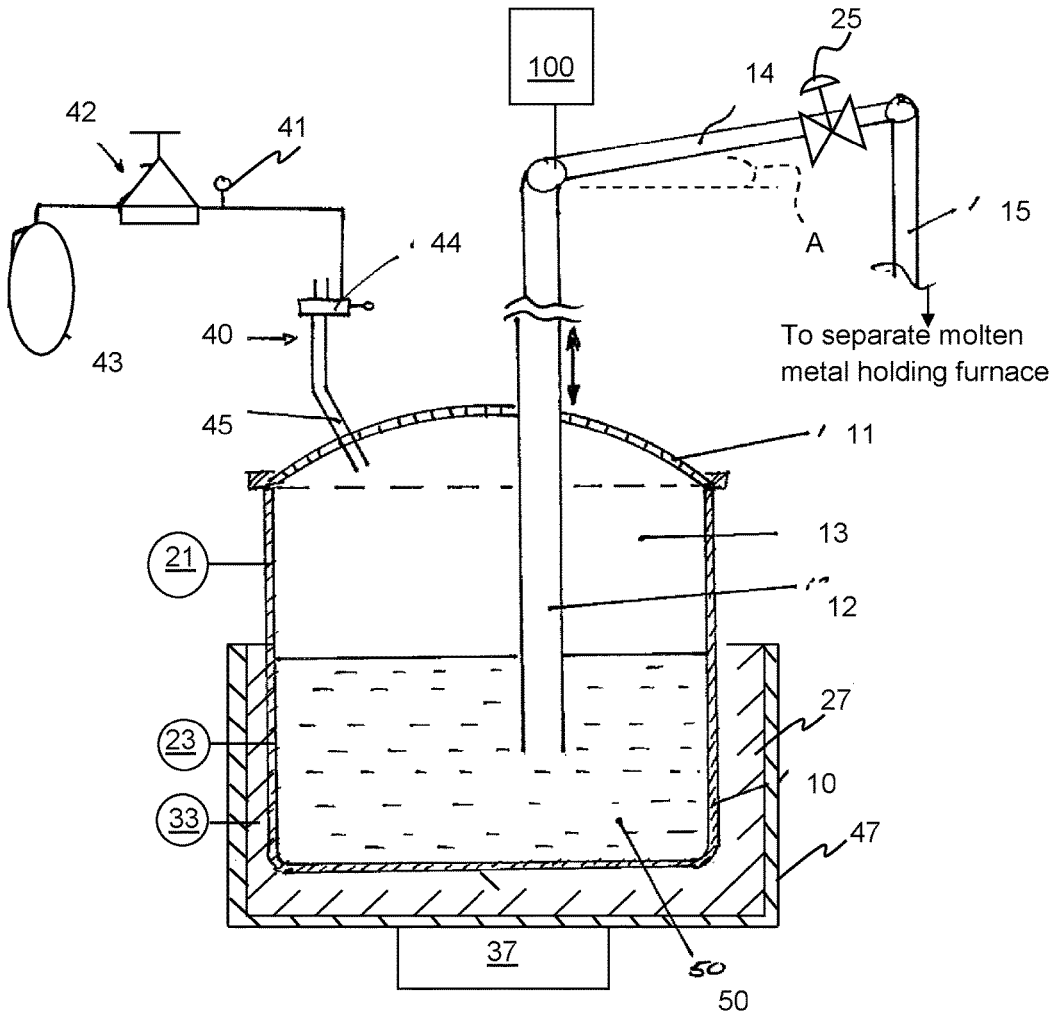
FIG. 1 is a partial cross-sectional schematic representation of the system and the apparatus.

For the system, method and apparatus according to this invention there is provided a crucible or vessel (10) being airtight sealable with a lid (11) and defining a chamber (13) for storing molten lithium (50) and an inert gas. The lid (11) can be removed for maintenance and cleaning of the vessel and the seals. The vessel is for a part filled with molten lithium having a surface level. There is provided a conduit (12), having a conduit inlet and a conduit outlet, for withdrawing a portion of the molten lithium (50) from the vessel (10). In this embodiment the conduit (12) is movably arranged with respect to lid (11) using one or more seals known in the art (not shown) such that in operation the conduit inlet can be controllably moved, e.g. using mechanical means (100), below and above the surface level of the molten metal. Also, the conduit (12) is arranged for feeding of the molten metal from the crucible to a separate molten metal holding furnace (not shown) with the help of an overpressure when the conduit inlet is below the surface level of the molten lithium, or submerged in the molten lithium, and the conduit is further arranged for feeding of the inert gas from the crucible to the separate molten metal holding furnace (not shown) when the conduit inlet is above the surface level of the molten lithium. The mechanical means for raising and lowering can be any suitable means, for example a hydraulic or pneumatic activated piston.

Appropriate seals for between the conduit and the vessel or vessel lid and that can withstand an operating temperature of up to about 260° C. and an overpressure of up to 200 mbar, and preferably up to about 80 mbar, are readily available.

The conduit and the vessel can be moved with respect to each other, e.g. by maintaining the conduit in a fixed position and lowering the vessel or alternatively by actively raising or lowering the conduit while maintaining the vessel in a fixed position. Although on a less preferred basis, but for the skilled person it will be immediately apparent that the conduit can also be swung into a position below or above the surface level of the molten lithium.

In operation the molten lithium or inert gas as the case may be, is fed to the molten aluminium alloy in the separate holding furnace (not shown) via a system of coupled conduits comprising a first conduit (12), second conduit (14) and third conduit (15). The second conduit (15) may have an upward angle of inclination (a), typically 5 to 45 degrees, to facilitate a back flow of molten lithium from the conduit(s) when the over-pressure is reduced when the required amount of molten lithium has been transferred to the molten aluminium in the holding furnace. The first conduit (12) and second conduit (14) may also form one conduit by taking a single conduit or tube and bending at least the end section to provide a curved conduit section that can be coupled to the third conduit (15). The curved section also facilitates a back flow of molten lithium when the over-pressure is reduced.

The third conduit (15) can be connected to a separate additional pressurised inert gas delivery system (not shown) for fluxing of the molten aluminium. By opening a valve (not shown) this may provide additional inert gas to the inert gas flowing from through the conduit system from the vessel (10). By closing valve (25) after the transfer of molten lithium and some initial inert gas for cooling down of the conduit system, it may form the only source of purging gas to flux the molten aluminium.

For alloying an about 6 tonnes aluminium alloy melt in the separate holding furnace about 50 kg to 200 kg of molten lithium needs to be transferred from the crucible or vessel in order to obtain the required Al—Li alloy composition. Correspondingly the crucible or vessel requires an inner volume in the range of about 120 to 800 litres, preferably up to about 500 litres.

The system further comprising a supply tank (43) of pressurised inert gas, the supply tank is interconnected to the chamber of the vessel through a gas delivery system (40) that includes a pressure regulator (42) and at least one valve (44) mounted on a supply tube (45) for the crucible. A pressure and/or temperature sensor (41) may also be provided. To bring molten lithium of a temperature of about 210° C. up by 20 mm an overpressure of about 1 mbar is required. In an industrial scale arrangement a working range for the overpressure would be in the range of about 20 to 200 mbar, and preferably in the range of about 40 to 80 mbar, e.g. 50 mbar.

As mentioned above, in an embodiment one or more of the conduits are provided with thermal insulation material to avoid solidification of the molten lithium present in the conduit when being feed from the crucible to the molten aluminium in the holding furnace.

Figure 2:
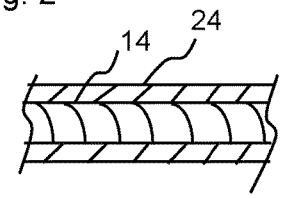
FIG. 2 is a partial cross-sectional schematic representation of an insulated heated conduit.

As also mentioned above, in a further embodiment next to the thermal insulation material a heating assembly is disposed about parts of one or more of the conduits located outside the crucible to avoid solidification of the molten lithium present in the conduit when being feed from the crucible to the molten aluminium in the holding furnace. For example electrical resistance heating is annularly disposed about at least a part of the conduit located outside the crucible. For example, FIG. 2 shows a portion of second conduit (14) with thermal insulation (24) and coils (14) which may be an electrical resistance heater.

Furthermore, the system may comprise different equipment (not shown) for the process, such as control cabinet for gas and associated valves in the system, a gas flow meter, for example, a rotameter, pipes and hoses, and an electricity supply. A pressure sensor (21) may be provided to measure pressure in the atmosphere of the chamber (13). A weight scale (37) may be provided to measure the weight of the crucible and thus weigh the lithium therein. Safety valves for a too high over-pressure can be provided. Also, a valve (25) may be provided on second conduit (14). Furthermore, one or more temperature measurement and control devices (23) can be provided for measuring the temperature of the molten lithium, and at least another temperature measurement and control device (33) to control the temperature of the heating device (27). In addition, control of the molten metal and gas transfer may be achieved by a controller (not shown) which may be equipped with a central processing unit (CPU), and content-addressable memory (for example, in the form of read-only memory (ROM) for storing a program which controls the operation of the overall apparatus and system, and a random-access memory (RAM) having a data storage area). The CPU is connected to an input/output interface (which may perform one or both of discrete and analog input and output), while additional signal-processing apparatus, such an an analog-to-digital (A/D) converter and one or more filter circuits. Such a controller may function as a digital signal processor, an application specific integrated circuit, a field programmable gate array, any suitable programmable logic device, discrete gate or transistor logic, discrete hardware components, or any combination thereof.

The heating device (27) may be any of the above mentioned heating devices. Moreover, the heating device (27) may be provided with thermal insulation (47).

The methodology according to this invention is useful for producing lithium containing aluminium alloys having a Li-content in the range of at least about 0.2 wt. % Li, and preferably at least about 0.6 wt. %, and which may contain up to about 10 wt. % of Li, and preferably up to about 4 wt. %. In particular alloys of the 2XXX, 5XXX, 7XXX, and 8XXX-series families, such as, but not limited to, AA2050, AA2055, AA2060, AA2065, AA2076, AA2090, AA2091, AA2094, AA2095, AA2195, AA2196, AA2097, AA2197, AA2297, AA2397, AA2098, AA2198, AA2099, AA2199, AA8024, AA8090, AA8091, AA8093, and modifications thereof, can be produced. As will be appreciated herein, the aluminium alloy designations refer to the Aluminum Association designations in Aluminum Standards and Data and the Registration Records as published by the Aluminum Association in 2013 and are well known to the person skilled in the art.

While various embodiments of the technology described herein have been described in detail, it is apparent that modifications and adaptations of those embodiments will occur to those skilled in the art. However, it is to be expressly understood that such modifications and adaptations are within the spirit and scope of the presently disclosed technology.

The invention claimed is:

1. A dual-use system for alternately adding molten lithium or an inert gas to a melt of molten aluminium or aluminium alloy in a separate molten metal holding furnace, the system comprising:

a crucible without a refractory on the inside thereof, defining a chamber for melting and storage of molten lithium, the crucible being equipped with a sealed lid;

an inert gas delivery system arranged for maintaining an overpressure in the chamber of the crucible using an inert gas; and a conduit, having a conduit inlet and a conduit outlet, for withdrawing a portion of the molten lithium from the crucible, and the conduit being movably arranged with respect to the crucible or the sealed lid such that the conduit inlet is controllably moveable to a first position below a surface level of the molten lithium in the crucible and a second position above the surface level of the molten lithium in the crucible, and wherein the conduit is arranged for feeding of the molten lithium from the crucible to the separate molten metal holding furnace with the help of the overpressure when the conduit inlet is in the first position below the surface level of the molten lithium in the crucible, and wherein the conduit is further arranged for feeding of the inert gas from the crucible to the separate molten metal holding furnace when the conduit inlet is in the second position above the surface level of the molten lithium in the crucible further comprising at least one heating unit and at least one temperature measurement and control unit.

2. The system according to claim 1, further comprising:

a supply tank of pressurised inert gas, the supply tank being interconnected to the chamber of the crucible through a gas delivery system that includes a pressure regulator and at least one valve mounted on a supply tube for the crucible.

3. The system according to claim 1, wherein the crucible is formed by a steel vessel or container.

4. The system according to claim 1, wherein the feeding of the molten lithium from the crucible to the separate molten metal holding furnace with the help of the overpressure is controllable via the inert gas delivery system.

5. The system according to claim 1, wherein overpressure is in a range of up to 200 mbar.

6. The system according to claim 1, wherein the conduit is adapted for feeding the molten lithium at a temperature in a range of up to 260° C.

7. The system according to claim 1, wherein at least a part of the conduit, or the conduit joined to a further conduit, has an upward inclination.

8. The system according to claim 1, wherein the overpressure is in a range of up to 80 mbar.

9. The system according to claim 1, wherein the overpressure is in a range of up to 200 mbar.

10. The system according to claim 1, the overpressure is in a range of up to 80 mbar.

11. The system according to claim 1, wherein the conduit outlet is adapted and configured to be communication with the separate molten metal holding furnace in the first position and the second position.

12. The system according to claim 1, wherein the metal holding furnace is an induction melting furnace.

13. The system according to claim 1, wherein the conduit is made from stainless steel with a BN coating.

14. The system according to claim 1, wherein the conduit outlet is in communication with the separate molten metal holding furnace when the conduit inlet is in the first position and when the conduit inlet is in the second position.

15. The system according to claim 14, wherein the crucible is airtight, and wherein the inert gas delivery system is in communication with the chamber of the crucible;

wherein the inert gas delivery system for maintaining the overpressure comprises an inert gas supply tube having an inert gas supply tube outlet located in an upper portion of the crucible for discharging the inert gas directly into the upper portion of the crucible over the surface level of the molten lithium in the crucible when the conduit inlet is in both the first and second positions.

16. The system according to claim 15, wherein the conduit comprises an upstream conduit segment in communication with the crucible, a downstream conduit segment in communication with the separate molten metal holding furnace, and optionally an intermediate conduit segment;

wherein:

(a) the upstream conduit segment is coupled to the downstream segment, or (b) the upstream conduit segment is coupled to a first end of the intermediate conduit segment and the downstream conduit segment is coupled to a second end of the intermediate conduit segment.

17. The system according to claim 16, further comprising a second inert gas delivery system in communication with the downstream conduit segment.

* * * * *